US005238429A

United States Patent [19]

Margrave et al.

[11] Patent Number: 5,238,429

[45] Date of Patent: Aug. 24, 1993

[54] ELECTRICAL ASSEMBLY AND CONNECTOR THEREFOR

[75] Inventors: Christopher A. Margrave; Kenneth C. Stevens, both of Cortland, Ohio

[73] Assignee: General Motors Corporation, Detroit, Mich.

[21] Appl. No.: 944,622

[22] Filed: Sep. 14, 1992

[51] Int. Cl.[5] ..... H01R 13/66

[52] U.S. Cl. ..... 439/620; 439/736

[58] Field of Search ..... 439/34–36, 439/32, 246, 476, 500, 638, 650, 654, 655, 535, 736, 620

[56] References Cited

U.S. PATENT DOCUMENTS

| | | | |
|---|---|---|---|
| 2,976,513 | 3/1961 | Sasserson | 439/36 X |
| 4,430,983 | 2/1984 | Hagen | 439/638 X |
| 4,871,331 | 10/1989 | Kondo et al. | 439/736 |
| 4,894,017 | 1/1990 | Stein et al. | 439/78 |
| 4,956,561 | 9/1990 | Tamer | 439/34 X |

*Primary Examiner*—Eugene F. Desmond

*Attorney, Agent, or Firm*—William A. Schuetz

[57] ABSTRACT

An electrical assembly comprises an electrical connector and an electrical device such as a sensor that are connected directly to each other. The electrical connector has a one-piece connector body of moldable, thermoplastic electrically insulative material that has a socket at one end for receiving a mating electrical connector, and a platform at the other end supporting the electrical device. One-piece terminals are insert molded in the connector body so that the insert molded terminals have exposed contacts at one end that project into the socket and exposed contacts at the other end that project outwardly of the platform. The electrical device is fastened to the platform mechanically and has prongs that engage the exposed contacts at the other end of the insert molded terminals. The electrical assembly may also include a second electrical device such as a diode that is fastened to the front of the platform and electrically connected to the exposed contacts of the insert molded terminals.

12 Claims, 2 Drawing Sheets

ELECTRICAL ASSEMBLY AND CONNECTOR THEREFOR

BACKGROUND OF THE INVENTION

This invention relates generally to electrical assemblies and more particularly to electrical assemblies comprising an electrical connector and an electrical device such as a sensor.

U.S. Pat. No. 4,894,017 granted to William L. Stein, Randy L. Fink and Bruce J. Serbin Jan. 16, 1990 discloses an electrical assembly comprising an electrical connector 10 and a sensor 51 that is disposed in a protective metal casing 50 that is filled with a potting compound 54. The electrical connector 10 and the sensor 51 are mechanically and electrically connected by means of a printed circuit board 39. Both components have plastic pins that are heat staked for fastening the components to the printed circuit board and both components have terminal prongs that are plugged in and soldered to apertured contacts of the printed circuit board. The housing 12 of the electrical connector 10 also includes a narrow peripheral groove 42 for mounting the electrical header connector 10 on a slotted panel wall of the protective metal casing 50.

SUMMARY OF THE INVENTION

The object of this invention is to provide an improved electrical assembly of the above noted type and an improved electrical connector for such an electrical assembly.

A feature of the improved electrical assembly is that the electrical connector and the electrical device are connected to each other directly both mechanically and electrically. This eliminates the need for a printed circuit board and reduces cost. This also reduces the number of electrical interfaces between the electrical connector and the electrical device from two to one. The reduction of electrical interfaces increases electrical reliability and performance and further reduces cost. Elimination of the printed circuit board also reduces the number of mechanical connections which also increases reliability and reduces cost.

A feature of the improved electrical connector is that the electrical connector has a connector body and terminals that are configured for supporting an electrical device and for connecting directly to the supported electrical device mechanically and electrically thereby eliminating the need for a printed circuit board or any other intervening element.

BRIEF DESCRIPTION OF THE DRAWINGS

The above and other objects, features and advantages of the invention will become more apparent from the following description taken in conjunction with the accompanying drawings wherein like references refer to like parts and wherein.

DESCRIPTION OF THE INVENTION

Figure 1:
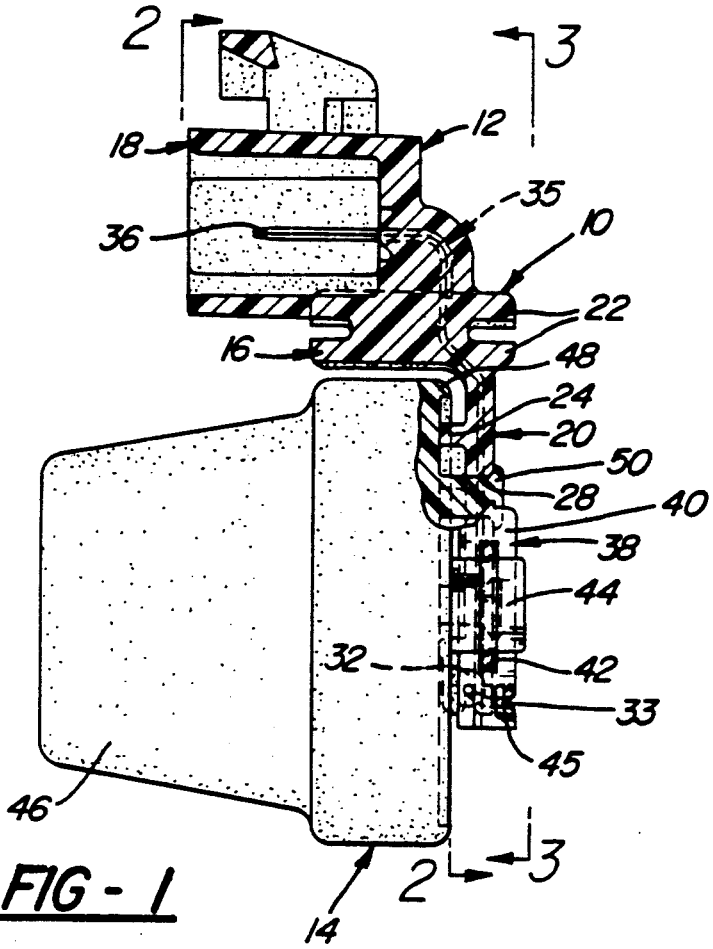
FIG. 1 is a side view of an electrical assembly in accordance with the invention.

Referring now to the drawing an electrical assembly 10 of this invention comprises an electrical connector 12 and an electrical device 14 such as a sensor that is used in automotive SIR systems. The electrical connector 12 and the electrical device 14 are connected to each other both mechanically and electrically without any intervening element such as a printed circuit board that is commonly used in prior art electrical assemblies of this type.

The electrical connector 12 is configured to support the electrical device 14 and make direct mechanical and electrical connections with the supported electrical device 14. More specifically the electrical connector 12 has a one-piece connector body 16 of moldable, thermoplastic electrically insulative material. The connector body 16 has an upright socket 18 at one end for receiving a mating electrical connector (not shown), and a cantilevered platform 20 at the other end for supporting the electrical device 14 in an upright position near the socket 18. The connector body 16 has a narrow peripheral groove defined by confronting flanges 22 that are disposed between the socket 18 and the platform 20. The narrow peripheral groove is used to mount the electrical assembly on a slotted panel wall of a protective metal casing as shown in FIG. 6 of U.S. Pat. No. 4,894,017 that is discussed in the introduction and that is incorporated in this patent specification by reference.

The cantilevered platform 20 has a curved rib 24 adjacent the flanges 22, a straight rib 26 at its free end and two holes 28 between the ribs for securing the electrical device 14 on the platform 20. The ribs 24 and 26 strengthen the platform 20 and also help locate the electrical device 14 for fastening to the platform. The platform 20 also has two laterally spaced bifurcated fingers 30 that project from the free end for optionally holding a second electrical device such as a diode 32 or other similar electrical device that has axial lead wires 33 extending from each end.

The electrical connector 12 also has two one-piece terminals 34 and 35 that are insert molded in the connector body 16. The insert molded terminals 34 and 35 have exposed, upright contacts 36 at one end of generally L-shaped stampings that project into the socket 18. The terminals 34 and 35 have exposed contacts 38 at the other end of the generally L-shaped stampings that project outwardly of the platform 20 in the lateral direction. The upright contacts 36 are in the form of double thickness blades that are formed by folding the one end of the stampings back over onto itself. The one end of the terminal 35 is bifurcated to form two upright contacts 36 at the one end.

The contacts 38 are flanged to provide upright walls 40 that are laterally spaced from the side edges of the platform 20. The walls 40 are slit to provide integral straps 42 that are raised outwardly of the walls 40 to form sockets for receiving flat prongs 44 of the electrical device 14 that is mounted on the platform. The walls 40 also have T-shaped slots 45 for receiving the ends of the lead wires 33 of the diode 32.

The electrical device 14 comprises a round housing 46 of thermoplastic material that has a circular lip 48 at the bottom. The housing also has two depending pins 50 that fit into the holes 28 when the electrical device 14 is plugged onto the platform 20. As indicated above, the electrical device has two flat prongs 44 that project from the bottom of the housing. These flat prongs 44 are connected to electrical componentry within the housing 46 and project from the bottom of the housing 46 to connect the internal electrical componentry with external electrical devices via the electrical connector 12.

The electrical device 14 is plugged onto the platform 20 of the electrical connector 12 so that the flat prongs 44 plug into the sockets of the contacts 38 and the plastic pins fit 50 into the holes 28. The plastic pins 50 are then heat staked to fasten the electrical device 14 and the electrical connector 12 together.

Figure 2:
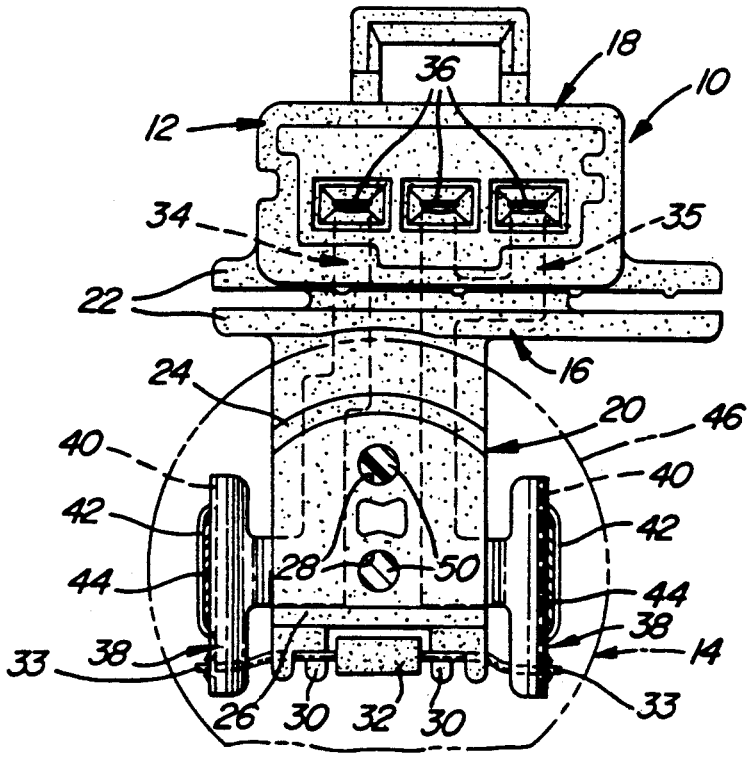
FIG. 2 is a section taken substantially along the line 2—2 of FIG. 1 looking in the direction of the arrows and showing a front view of the electrical connector that is used in the electrical assembly of FIG. 1.
Figure 3:
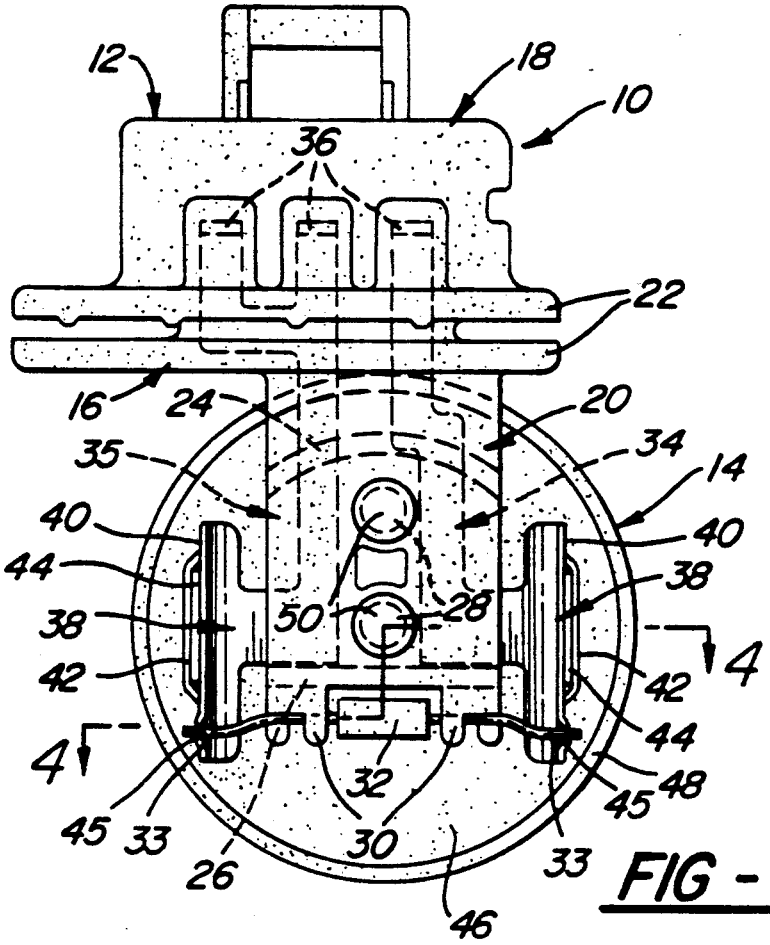
FIG. 3 is a rear view of the electrical assembly taken substantially along the line 3—3 of FIG. 1 looking in the direction of the arrows.
Figure 4:
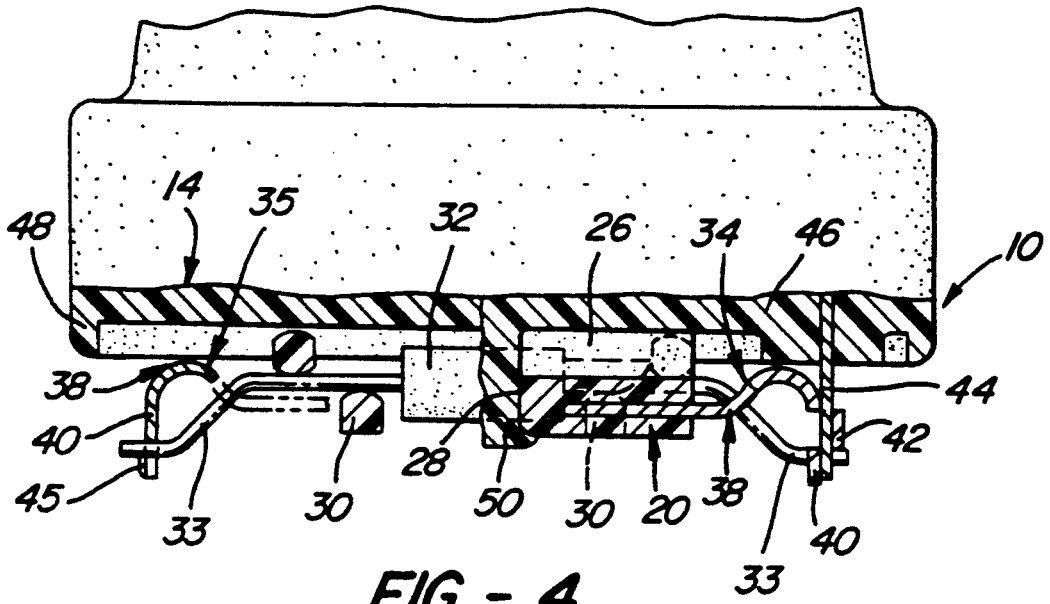
FIG. 4 is a section taken substantially along the line 4—4 of FIG. 3 looking in the direction of the arrows.

If desired another electrical device such as a diode 32 may be incorporated in the electrical assembly 10. This diode 32 is mechanically fastened and electrically connected to the electrical connector 12 by the lead wires 33 of the diode. The lead wires 33 are wedged in the bifurcated fingers 30 as shown in FIGS. 2, 3 and 4 to fasten the diode 32 to the front of the platform 20 while the ends of the lead wires 33 are wedged in the T-shaped slots 45 of the contacts 38 to connect the diode 32 to the electrical connector 12 electrically.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. An electrical assembly comprising:

an electrical connector having a one-piece connector body of moldable, thermoplastic electrically insulative material, the connector body having a socket at one end for receiving a mating electrical connector, and a platform at the other end for supporting an electrical device, the electrical connector having a plurality of one-piece terminals that are insert molded in the connector body, the insert molded terminals having exposed contacts at one end that project into the socket and exposed contacts at the other end that project outwardly of the platform, and an electrical device mounted on the platform, means for fastening the electrical device to the platform mechanically, and the electrical device having prongs engaging the exposed contacts at the other end of the insert molded conductors to connect the electrical device to the electrical connector electrically.

2. An electrical assembly comprising;

an electrical connector and an electrical device that are connected to each other directly mechanically and electrically without any intervening element;

the electrical connector having a one-piece connector body of moldable, thermoplastic electrically insulative material that has an upright socket at one end for receiving a mating electrical connector and a cantilevered platform at the other end for supporting the electrical device in an upright position near the socket;

the cantilevered platform having means for locating and securing the electrical device on the platform;

the electrical connector further including one-piece terminals that are insert molded in the connector body and that have exposed, upright contacts at one end that project into the socket;

the terminals also having exposed contacts at the other end that project outwardly of the platform in the lateral direction;

the last said contacts being shaped to form sockets;

the electrical device being supported on the platform and having prongs that are received in the sockets; and the cantilevered platform and the electrical device having cooperating means locating and securing the electrical device on the platform.

3. The electrical assembly as defined in claim 2 further comprising:

a second electrical device having lead wires extending axially from opposite ends of the electrical device;

the platform having means at the free end holding the second electrical device; and the last said contacts having slots that receive respective ends of the lead wires of the second electrical device.

4. An electrical assembly comprising;

an electrical connector and an electrical device that are connected to each other directly mechanically and electrically without any intervening element;

the electrical connector being configured to support the electrical device and make direct mechanical and electrical connections with the electrical device;

the electrical connector having a one-piece connector body of moldable, thermoplastic electrically insulative material that has an upright socket at one end for receiving a mating electrical connector and a cantilevered platform at the other end for supporting the electrical device in an upright position near the socket;

the cantilevered platform having a curved rib toward the socket, a straight rib at its free end and at least one hole between the ribs for securing the electrical device on the platform;

the electrical connector further including two one-piece terminals that are insert molded in the connector body and that have exposed, upright contacts at one end of generally L-shaped stampings that project into the socket;

the terminals also having exposed contacts at the other end of the generally L-shaped stampings that project outwardly of the platform in the lateral direction;

the last said contacts being flanged to provide upright walls that are laterally spaced from the side edges of the platform and that are slit to provide integral straps that are raised outwardly of the walls to form sockets for receiving flat prongs of the electrical device that is mounted on the platform;

the electrical device having a housing of thermoplastic material that has a circular lip at the bottom and at least one depending pin that fits into the hole when the electrical device is plugged onto the platform;

the electrical device having two prongs that project from the bottom of the housing and plug into the sockets of the last contacts; and the plastic pin being heat staked to fasten the electrical device and the electrical connector together.

5. The electrical assembly as defined in claim 2 further comprising:

a second electrical device having lead wires extending axially from opposite ends of the electrical device;

the platform having two laterally spaced bifurcated fingers that project from the free end and receive the respective lead wires of the second electrical device to hold the second electrical device; and the walls of the last said contacts having T-shaped slots that receive respective ends of the lead wires of the second electrical device.

6. The electrical assembly as defined in claim 4 wherein:

the upright contacts are in the form of double thickness blades that are formed by folding the one end of the stampings back over onto itself; and the one end of one of the terminals is bifurcated to form two upright contacts at the one end.

7. An electrical connector for an electrical assembly having an electrical connector and an electrical device that are directly connected to each other without any intervening element comprising:

a one-piece connector body of moldable, thermoplastic electrically insulative material, the connector body having a socket at one end for receiving a mating electrical connector, and a platform at the other end for supporting an electrical device, the electrical connector having a plurality of one-piece terminals that are insert molded in the connector body, the insert molded terminals having exposed contacts at one end that project into the socket and exposed contacts at the other end that project outwardly of the platform for engaging prongs of an electrical device when it is mounted on the platform, and the platform having means for fastening an electrical device to the platform mechanically.

8. An electrical connector for an electrical assembly having an electrical connector and an electrical device that are connected to each other directly mechanically and electrically without any intervening element comprising;

a one-piece connector body of moldable, thermoplastic electrically insulative material that has an upright socket at one end for receiving a mating electrical connector and a cantilevered platform at the other end for supporting the electrical device in an upright position near the socket;

the cantilevered platform having means for locating and securing an electrical device on the platform;

the electrical connector further comprising one-piece terminals that are insert molded in the connector body and that have exposed, upright contacts at one end that project into the socket;

the terminals also having exposed contacts at the other end that project outwardly of the platform in the lateral direction and that are shaped to form sockets for receiving prongs of an electrical device when it is located and secured on the platform.

9. The electrical connector as defined in claim 8 wherein:

the platform has means at the free end for holding a second electrical device; and the last said contacts have slots for receiving respective ends of lead wires of a second electrical device.

10. The electrical connector as defined in claim 8 wherein:

the cantilevered platform has a curved rib toward the socket, a straight rib at its free end and at least one hole between the ribs for securing an electrical device on the platform;

the exposed, upright contacts of the one-piece terminals are at one end of generally L-shaped stampings;

the exposed contacts that project outwardly of the platform are at the other end of the generally L-shaped stampings and project outwardly in the lateral direction; and the last said contacts are flanged to provide upright walls that are laterally spaced from the side edges of the platform and that are slit to provide integral straps that are raised outwardly of the walls to form sockets for receiving flat prongs of an electrical device when it is secured on the platform.

11. The electrical connector as defined in claim 10 wherein:

the platform has two laterally spaced bifurcated fingers that project from the free end for receiving respective lead wires of a second electrical device to hold the second electrical device mechanically; and the walls of the last said contacts have T-shaped slots for receiving respective ends of the lead wires of the second electrical device to connect the second electrical device to connect the electric connector electrically.

12. The electrical connector as defined in claim 10 wherein:

the upright contacts are in the form of double thickness blades that are formed by folding the one end of the stampings back over onto itself; and the one end of one of the terminals is bifurcated to form two upright contacts at the one end.

* * * * *